US010391762B2

(12) United States Patent
Sender Beleta et al.

(10) Patent No.: US 10,391,762 B2
(45) Date of Patent: Aug. 27, 2019

(54) PAGE WIDE ARRAY PRINTER

(71) Applicant: Hewlett-Packard Development Company, L.P., Houston, TX (US)

(72) Inventors: Jordi Sender Beleta, Barcelona (ES); Joshua A. Mann, Ramona, CA (US); M. Isabel Borrell Bayona, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/673,966

(22) Filed: Aug. 10, 2017

(65) Prior Publication Data

US 2017/0334194 A1 Nov. 23, 2017

Related U.S. Application Data

(63) Continuation of application No. 14/780,806, filed as application No. PCT/EP2013/056965 on Apr. 2, 2013, now Pat. No. 9,776,392.

(51) Int. Cl.
*B41J 2/21* (2006.01)
*B41J 2/045* (2006.01)

(52) U.S. Cl.
CPC ..... *B41J 2/04505* (2013.01); *B41J 2/2132* (2013.01); *B41J 2/2146* (2013.01)

(58) Field of Classification Search
CPC ..... B41J 2/2139
See application file for complete search history.

(56) References Cited

U.S. PATENT DOCUMENTS

| | | | |
|---|---|---|---|
| 6,575,549 | B1 | 6/2003 | Silverbrook |
| 7,338,144 | B2 | 3/2008 | Mantell et al. |
| 7,625,063 | B2 | 12/2009 | White et al. |
| 8,733,892 | B2 | 5/2014 | Duchene et al. |
| 2005/0078133 | A1 | 4/2005 | Molinet et al. |
| 2006/0268024 | A1 | 11/2006 | Youn |
| 2007/0024668 | A1 | 2/2007 | Folkins |
| 2008/0314276 | A1 | 12/2008 | Gothait et al. |
| 2009/0091596 | A1 | 4/2009 | Askeland et al. |
| 2009/0128599 | A1 | 5/2009 | Puigardeu et al. |

(Continued)

FOREIGN PATENT DOCUMENTS

| | | |
|---|---|---|
| CN | 1248200 | 3/2000 |
| CN | 1364116 | 8/2002 |

(Continued)

OTHER PUBLICATIONS

Wijshoff, Herman. "The Dynamics of the Piezo Inkjet Printhead Operation", Mar. 31, 2010, Physics Report, pp. 77-177.

(Continued)

*Primary Examiner* — Julian D Huffman
(74) *Attorney, Agent, or Firm* — HP Inc. Patent Department

(57) ABSTRACT

The present disclosure discloses a page wide array (PWA) printer (20) particularly but not exclusively for performing print jobs while maximizing print bar performance uniformity within the printer. The PWA printer includes a print bar which can be moved laterally and a controller which causes the print bar to laterally move from a first to a second position and causes the nozzles within the print bar to print an image while the print bar is in the second position without modifying the lateral alignment of the image.

10 Claims, 4 Drawing Sheets

(56) References Cited

U.S. PATENT DOCUMENTS

| | | | |
|---|---|---|---|
| 2012/0147092 | A1 | 6/2012 | Achatz et al. |
| 2012/0314001 | A1 | 12/2012 | Mizes |

FOREIGN PATENT DOCUMENTS

| | | |
|---|---|---|
| CN | 1454150 | 11/2003 |
| CN | 1817655 | 8/2006 |
| CN | 1872547 | 12/2006 |
| CN | 101663171 | 3/2010 |
| CN | 102917881 | 2/2013 |
| WO | 98/36910 | 8/1998 |
| WO | 00/76773 | 12/2000 |
| WO | 2008065657 | 6/2008 |

OTHER PUBLICATIONS

International Search Report, dated Jan. 14, 2014, PCT Patent Application No. PCT/EP2013/056965, 3 pp.

PAGE WIDE ARRAY PRINTER

BACKGROUND

The present disclosure relates to page-wide array (PWA) printers and to a method for printing in such printers.

In general, a PWA printer includes a print bar along which an array of nozzles is provided, the print bar extending the full width of the substrate (or medium) upon which an image is to be printed. Such an arrangement usually allows most of the width of the substrate to be printed simultaneously. The substrate or medium may be any sort of sheet-like or web-based medium, including paper, cardboard, plastic and textile.

The print bar is usually fixed within PWA printers and a substrate on which an image is to be printed is moved past the nozzles along a substrate transport path. The complete image is generally printed in a single printing pass.

The present disclosure intends to provide PWA printers with better printing performance.

DETAILED DESCRIPTION

Figure 1:
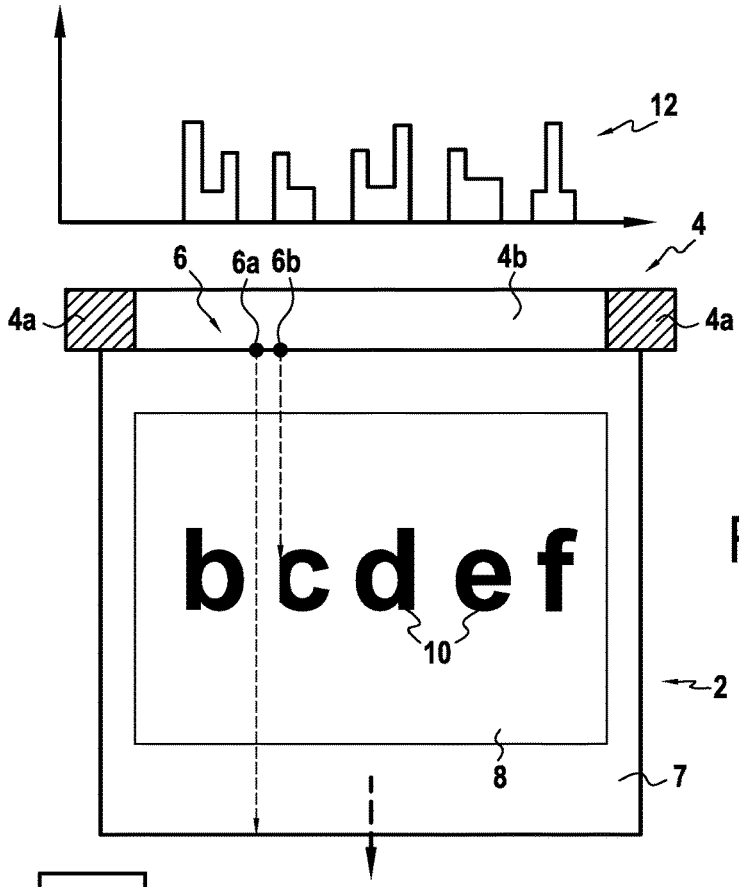
FIG. 1 illustrates the uneven usage of nozzles in a conventional PWA printer.

FIG. 1 schematically shows an example of a PWA printer 2 including a print bar 4 which is used to print an image 8 on a substrate 7. The print bar 4 includes an array of nozzles 6 along its length. The two end portions 4*a* of the print bar 4 are not used along the entire print of image 8. The used portion 4*b* of print bar 4 allows printing of the image 8 on the substrate 7. In this case, the nozzles 6 are driven to print characters 10 ("b", "c", "d", "e", and "f") on the substrate 7.

It has been observed that the nozzles in a PWA printer may not uniformly used within the print bar. Statistically, certain nozzles within the print bar may be used more often than others, thereby causing non-uniform nozzle ageing along the print bar. This inherent non-uniformity of the nozzle ageing may be made even worse due to the international standardization of plot elements such as the border and the title block in mechanical and architecture drawings. If for instance a same vertical line extending along a margin is present in each of a plurality of printed pages, the nozzle(s) located in lateral alignment with these vertical lines will be more frequently used than others. The usage distribution of the nozzles may also be uneven along the print bar when a user sends multiple copies of the same job for instance.

The highly used nozzles may negatively impact image quality. Non-uniform nozzle ageing may translate into defective behaviours (such as lower drop weight or lower velocity) sooner than the rest of the nozzles. Eventually, when the print bar is instructed to print a uniform area with nozzles that have dramatically different ages, the printing quality of the image on the substrate may become unacceptable due to, for example, visible coloration defects etc. At that point, the print bar may need to be replaced to maintain an acceptable level of printing quality.

In FIG. 1, the PWA printer 2 is performing one-pass printing. In the case where nozzles 6*a* and 6*b* are defective due for instance to accelerated ageing, it may cause the occurrence of a blank column on the image 8 which leads to the printing failure of part of the character "c" in this example.

The present disclosure provides a PWA printer and a method for maximizing print bar performance uniformity by means of enabling the lateral movement of the print bar between print jobs or within the process of a printing job. By performing such lateral movements, a more uniform usage of the nozzles within the print bar can be achieved, thereby significantly improving the printing quality.

Figure 2:
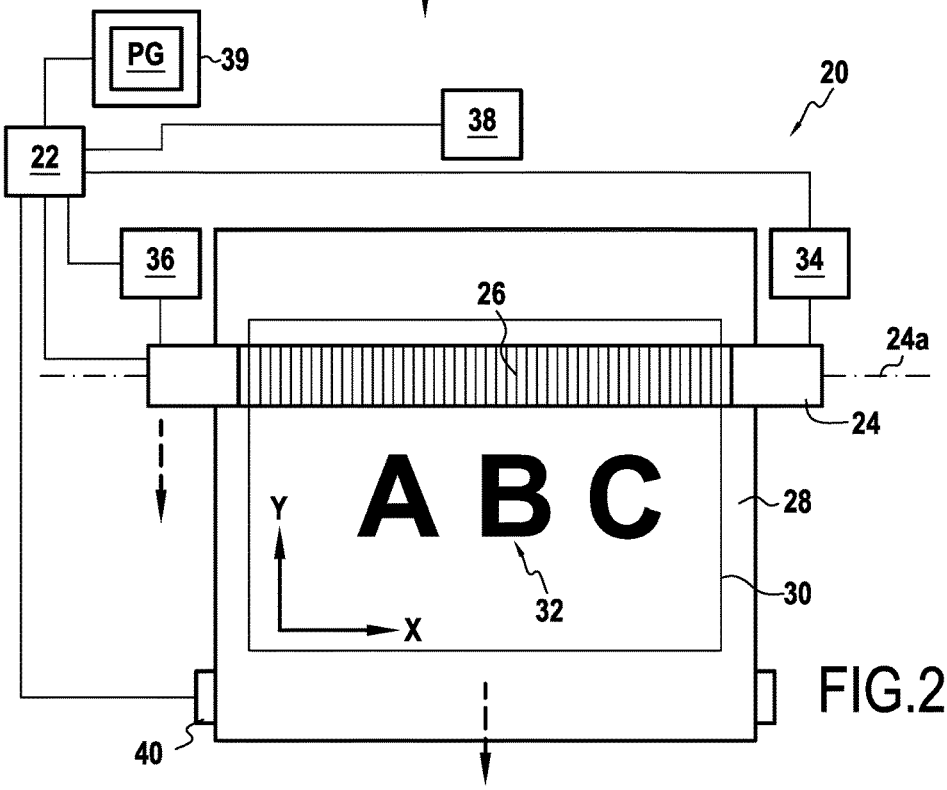
FIG. 2 represents a PWA printer according to a particular example of the present disclosure.

An inkjet PWA printer 20 according to a particular example of the present disclosure is now described in reference to FIG. 2.

The PWA printer 20 includes a print bar 24 extending in the direction 24*a* of the print bar axis. A plurality of nozzles 26 are provided along the print bar 24, these nozzles being operable to print upon a substrate 28. As indicated above, a substrate may be any sort of sheet-like or web-based medium, including paper, cardboard, plastic and textile.

Ink is supplied to the nozzles 26 from an ink tank 34. The number of nozzles may for instance be in the region of a hundred, one thousand or more, depending on the case. The structure of the nozzles in this example is conventional and will therefore not be described in detail.

The PWA printer 20 further includes a substrate transport mechanism 40 which in use is operative to transport the substrate 28 along a substrate transport path (in a Y direction) below the nozzles 26 of the print bar 24.

The PWA printer 20 also includes a print bar transport mechanism 36 which in use is operative to laterally move the print bar 24 along the print bar axis direction 24*a* (i.e. the longitudinal direction of the print bar 24). The print bar transport mechanism 36 enables to laterally move the print bar 24 relative to the substrate 28 in the X direction. In this example, the substrate 28 does not move in the X direction, the relative position with the print bar 26 in the X direction being only controllable by laterally moving the print bar 26. However, in another example, the substrate may also be moved laterally in the X direction to control the lateral position of the substrate relative to the print bar 26.

In this particular example, printer controller 22, such as a microprocessor, for example, is operative to control:

- the firing of the nozzles;
- the lateral movement of the print bar in the X direction by sending commands to the print bar transport mechanism 36;
- the movement of the substrate 28 in the Y direction by sending commands to the substrate transport mechanism 40;
- the supply of the ink of the nozzles 26 from the ink tank 34.

In this example, the controller 22 has access to a memory 38 (for example a computer memory such as a solid-state RAM). Images or jobs for the printer to print are stored in memory 38 until they have been printed onto a substrate by the printer.

In this example, the controller 22 has also access to a non-volatile rewritable memory 39 (such as an EEPROM for instance) in which is stored a computer program PG. The memory 39 constitutes a recording medium according to the present disclosure, readable by a controller, and on which is stored a computer program PG according to the present disclosure, this computer program including instructions for carrying out a printing method according to the present disclosure.

The controller 22 is operable to:

- cause the nozzles 26 to print a first image in a first lateral alignment on a substrate while the print bar 24 is in a first lateral position (in the X direction);
- laterally move the print bar 24 from the first to a second lateral position (in the X direction); and
- cause the nozzles 26 to print a second image at the first lateral alignment while the print bar is in the second lateral position while the print bar 24 is in the second lateral position.

Figure 3:
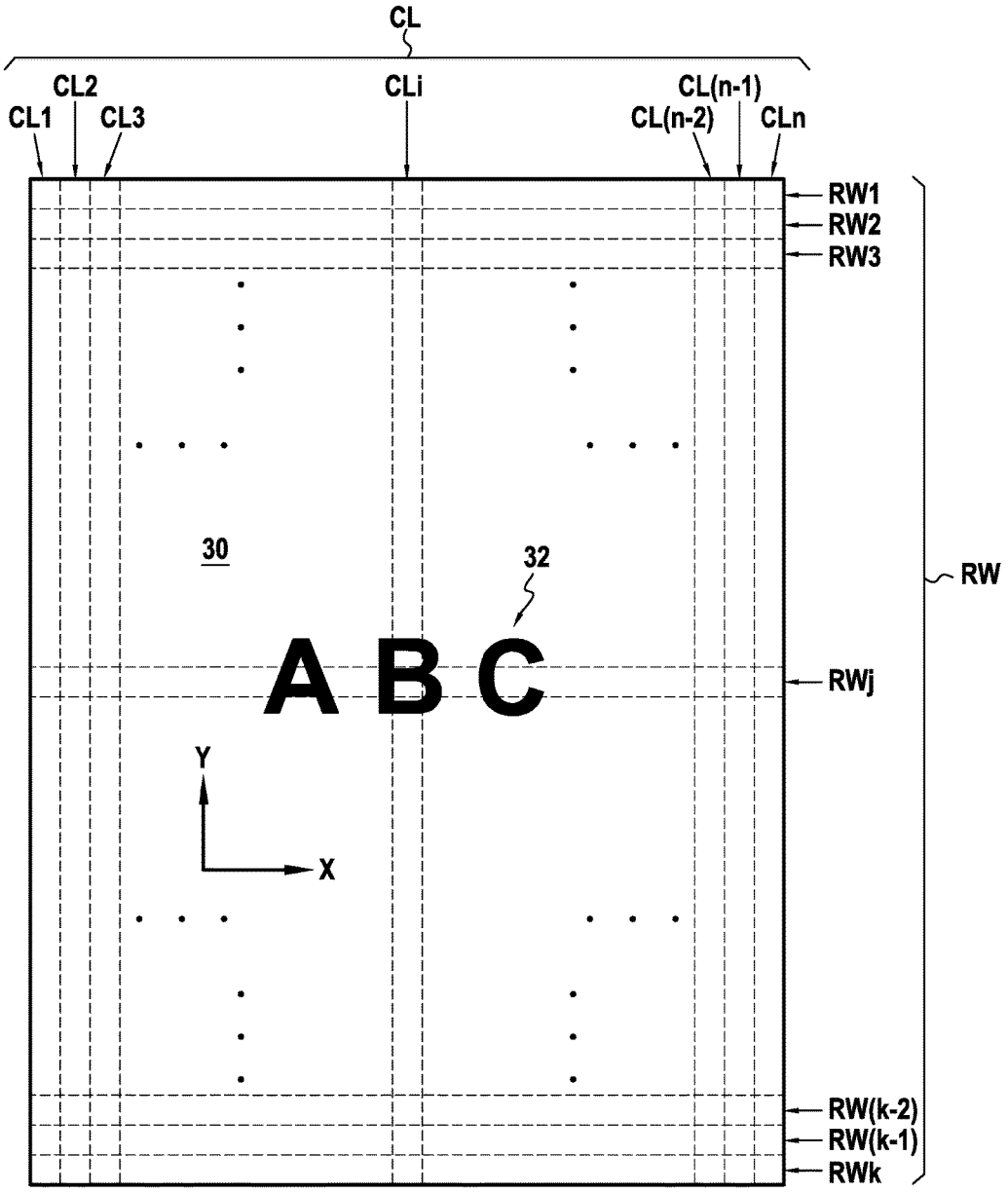
FIG. 3 represents the data structure of an image to be printed by the PWA printer of FIG. 2, according to one example.

FIG. 3 schematically shows an exemplary data structure of the image 30 which is to be printed upon substrate 28. In this example, image 30 has a predetermined format and includes characters ("A", "B" and "C"). The image 30 can be represented by a plurality of data columns CL and a plurality of data rows RW.

To print image 30, the controller 22 transmits data columns to the print bar 24, each data column CL being input to a corresponding nozzle 26 so that the nozzles 26 which receive the data columns can collectively print the full image 30 upon the substrate 28, one row after the other.

A method for printing an image in accordance with the present disclosure will now be described in reference with FIGS. 4 to 6.

More specifically, the PWA printer 20 carries out a printing method by executing the computer program PG stored in memory 39.

The nozzles 26 arranged within the print bar 24 are here named N1 to N100 from left to right. As already indicated above, the number of nozzles may however be adapted depending on each case.

A particular example will now be considered where three images 30*a*, 30*b* and 30*c* made each of 98 data columns are successively printed by the PWA printer 20 upon three respective separate substrates 30*a*, 30*b* and 30*c*. It should however be understood that other numbers of data columns could be contemplated when implementing the present printer.

Figure 4A:
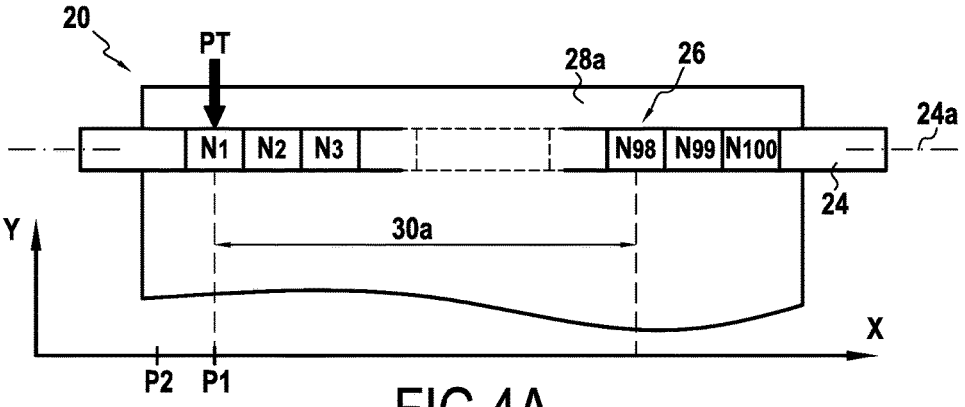
FIGS. 4A, 4B and 4C represent schematically the operation of the PWA printer of FIG. 2 in three different configurations, according to one example.

FIG. 4A shows a first configuration where the nozzle N1 is positioned at a predetermined lateral position P1 in the X direction. This predetermined lateral position may be adapted to each case. In the present example, the predetermined lateral position is defined as the position in the X direction where the first data column CL1 of the image is to be printed on the substrate. Other predetermined lateral positions may be contemplated when implementing the present printer.

In the present case, nozzle N1 is positioned at position P1 in the X direction and, as such, is designated as the "first nozzle". A pointer PT is used in this example by the controller 22 to identify the nozzle designated as first nozzle.

The controller 22 is configured to input the first data column CL1 of each image to the "first nozzle" which is currently positioned at P1 at the time of processing, and to input the remaining data columns of each image to the nozzles adjacent to the first nozzle so that the nozzles can collectively print each image on a respective substrate.

It should be noted that several images may be printed on a same substrate or, alternatively, on dedicated substrates depending on the case. Each printing of an image constitutes a print job.

More specifically, as a first print job, the controller 22 inputs the first data column CL1 of the first image 30*a* to the nozzle N1 which is positioned at P1, and inputs the remaining data columns CL2 to CL98 of image 30*a* to the nozzles N2-N98 adjacent to CL1. The nozzles CL1 to CL98 are thus collectively configured to print each row RW in turn of the first image 30*a* on the substrate 28*a*.

In the case of FIG. 4A, the nozzles CL99 and CL100 are not used to print the image 30*a* on the substrate 28*a*. In this example, no data is input to nozzles CL99 and CL100 while N1 is the first nozzle.

Figure 5:
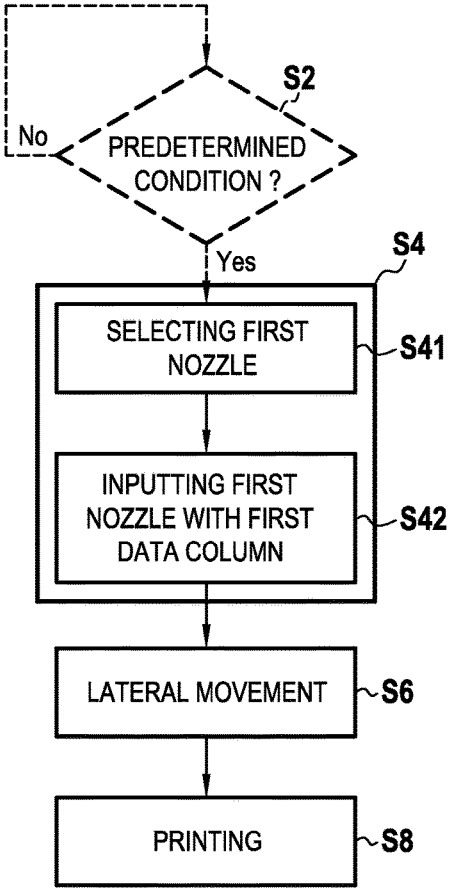
FIG. 5 is a sequence diagram showing the main features of the printing method according to a particular example of the present disclosure.

As shown in FIG. 5, once the print job of the first image 30*a* is terminated, the controller 22 reconfigures (S4) the nozzles of the print bar 24 and laterally moves (S6) the print bar 24 along the print bar axis 24*a* so that any subsequent image is printed in lateral alignment with the previously printed image 30*a*. In other words, the reconfiguration S4 allows to perform any subsequent print job without the lateral alignment of the image to be printed being modified. Without such nozzle reconfiguration, the lateral movement (S6) of the print bar 24 would cause a lateral shift (in the X direction) of the subsequent images on their respective substrate.

S4 and S6 can be performed in any order, or simultaneously.

An example of implementation of S4 and S6 is now described with reference to FIG. 5.

In this particular example, the nozzle reconfiguration S4 includes selecting (S41) a nozzle as the "first nozzle" and inputting (S42) the data columns of the image 30*b* to be printed to the appropriate nozzles 26 of the print bar 24 based on the nozzle selection made in S41.

More specifically, in S41, the controller 22 selects one nozzle among a predefined subset SB of nozzles within the print bar 24. In the present case, the subset SB among which the nozzle selection is to be performed is composed of N1, N2 and N3. The size and content of the subset SB may be adapted to each case.

In this example, the nozzle selection S41 is performed at a time which is determined randomly by the controller 22. In a preferred configuration, the nozzle selection S41 is always performed between two print jobs (i.e. while no printing is in progress in the PWA printer 20).

In another example, a nozzle selection S41 may be triggered by the controller 22 each time it detects that at least one predetermined condition is met. In one example, before S4 and S6, the controller 22 may for instance verify (S2) on a regular basis (e.g. at the end of each print job) whether at least one predetermined condition is met. The at least one condition may include any one of the following:

- a predetermined total number of print jobs already performed;
- a predetermined level of usage of the nozzles;
- a predetermined time elapsed since a previous nozzle selection; and
- usage of a predetermined plot type.

In this particular example, each time the controller 22 detects (S2) that the at least one predetermined condition is met, it proceeds with carrying out S4 and S6. The predetermined condition(s) can be defined beforehand by the user for instance and may be stored in memory 39.

In a particular example, a nozzle selection S41 is triggered each time a (configurable) predetermined number of printed pages is reached.

Furthermore, in S41, the controller 22 is arranged such that it is statistically not always the same nozzle of the subset SB which is selected at S41. As a result, the selected nozzle will vary from time to time even though, in some configurations, a same nozzle within the subset SB may be selected several times in a row.

In a first arrangement, the controller 22 may be configured to select (S41) at random the nozzle within the subset SB.

In a second arrangement, the controller 22 may be configured to select (S41) the nozzle within the subset SB according to a predetermined rule. The controller 22 may for instance be configured such that, at each nozzle selection (S41), the nozzle selected is different from the nozzle selected at the previous nozzle selection.

In a particular example, each of the nozzles of the subset SB are successively selected one after the other at each nozzle selection in a cyclic manner.

In another example, the print bar is moved the same distance each time S6 is performed so as to select each nozzle of the subset SB successively until one end of the subset SB is reached at S41, and then the print bar 24 is moved back step by step at each execution of S6 to the initial position of FIG. 4A (and so on). This "incremental" configuration allows to minimize the number of print bar movements. This latter example will be considered in the following part of the document.

Figure 4B:
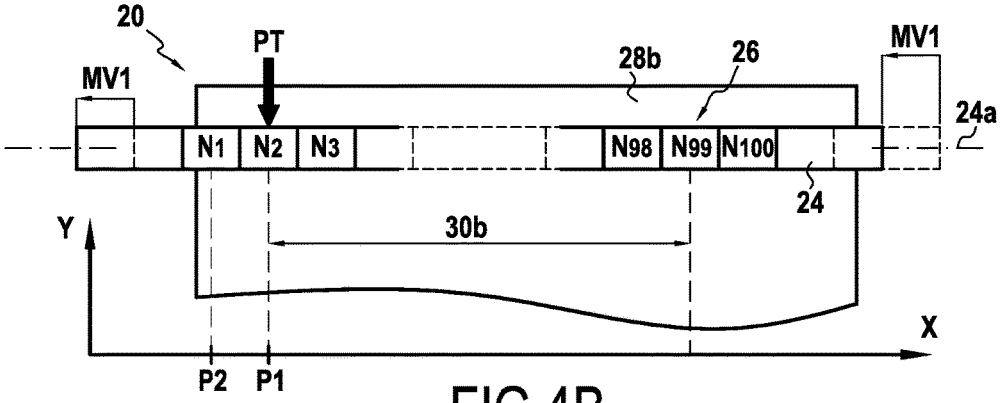

As shown in FIG. 4B, it is here assumed that the controller 22 selects (S41) the nozzle N2 within the subset SB as the new "first nozzle" which is to be positioned at P1 in the X direction.

The controller 22 then transmits (S42) the image data to be printed to the print bar 24 such that the first data column CL1 of the second image 30*b* is input to the selected nozzle N2, and the remaining data columns CL2-CL98 of said image are input respectively to the adjacent nozzles N3 to N99 so that the nozzles N2-N99 can print collectively the second image 30*b*.

The controller 22 also positions (S6; MV1) laterally the print bar 24 relative to the substrate on which the second image 30*b* is to be printed such that the selected nozzle N2 is laterally positioned in alignment with the predetermined position P1 on the substrate.

The second print job is then performed by the PWA printer 20 without modifying the lateral alignment of image 30*b* on the substrate 28*b* in comparison with image 30*a* on substrate 30*a*. The nozzles N2 to N99 print respectively the data columns CL1 to CL98 so as to print collectively the second image 30*b* on the substrate 28*b*. Nozzle N1 is now in position P2 and is no longer used in the process of printing.

The process of reconfiguring (S4) the nozzles 26 of the print bar 22 and moving laterally (S6) the print bar 22 can be performed between each print job (in the time elapsed between print jobs) or, alternatively, only between certain print jobs, depending on the trigger being implemented (see above).

Figure 4C:
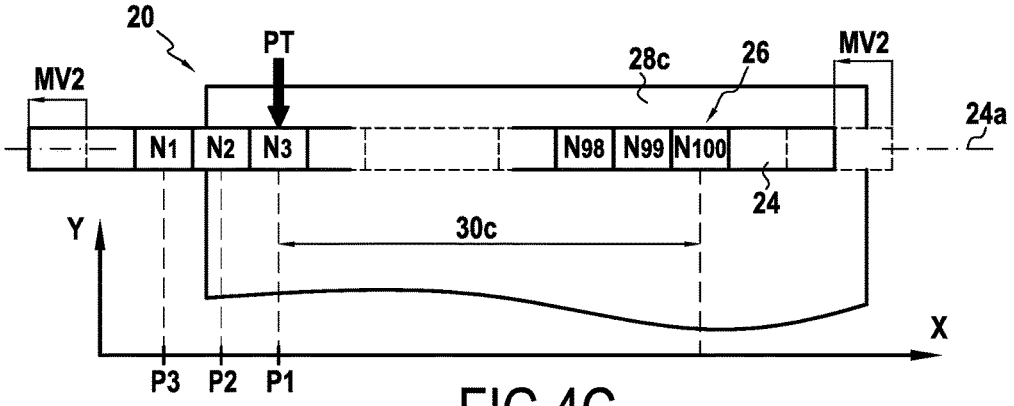

FIG. 4C shows a following stage of this example where the controller 22 again reconfigure the nozzles 26 within the print bar 22 and moves laterally the print bar 22 in the X direction. In this case, the controller 22 selects (S41) the nozzle N3 as the new "first nozzle" which is to be placed at the lateral position P1. The controller 22 also transmits (S42) the image data to be printed to the print bar 24 such that the first data column CL1 of the third image 30*c* is input to the selected nozzle N3, and the remaining data columns CL2-CL98 of said image are input respectively to the adjacent nozzles N4 to N100 so that the nozzles N3-N100 can print collectively the third image 30*c*.

The controller 22 also positions (S6; MV2) laterally the print bar 24 relative to the substrate 28*c* on which the third image 30*c* is to be printed such that the selected nozzle N3 is positioned in alignment with the predetermined position P1 on the substrate.

The third print job is then performed by the PWA printer 20 without modifying the lateral alignment of image 30*c* on the substrate 28*c* in comparison with image 30*a* (or 30*b*) on substrate 30*a* (or 30*b*). The nozzles N3 to N100 print respectively the data columns CL1 to CL98 so as to print collectively the third image 30*c* on the substrate 28*c*.

Figure 6:
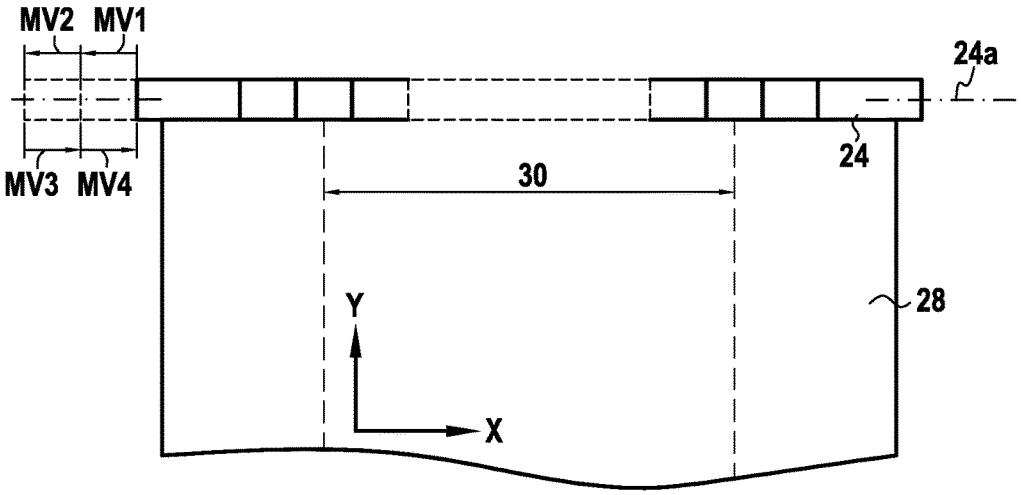
FIG. 6 represents a particular example where the print bar is laterally moved according to an incremental implementation.

FIG. 6 shows an exemplary implementation of the incremental configuration described above. As indicated above, laterally moving the print bar according to MV1 and MV2 allows to print an image using respectively nozzle N2 and N3 as the "first nozzle" in position P1. At the two subsequent occurrence of S6, the controller 22 then laterally moves the print bar 24 according to MV3 and MV4 (in the opposite direction to MV1 and MV2). As already mentioned, the "incremental" configuration allows to minimize the number of print bar movements.

The PWA printer according to the present disclosure is advantageous in that it enables to maximize print bar performance uniformity. In other words, with the present arrangement, a more uniform nozzle ageing can be achieved in a PWA printer, thereby significantly reducing the print defects that are usually observed with conventional PWA printers.

The PWA printer also allows increasing the life of the nozzles in the print bar.

In particular, when the present printing method is performed in a one-pass PWA printer, high printing quality can be maintained longer.

The PWA printer and printing method according to the present disclosure can address the following problems:

- non-uniform ageing of the nozzles by forcing a more even use of nozzles;
- print bar defects by optimizing print bar positioning to the plot to be printed;
- colour changes induced by the print bar ends by reducing idle time of the nozzles at the two ends of the print bar.

By indexing the nozzles and reconfiguring them at each lateral movement of the print bar, it is possible to print all the images according to a same lateral alignment. Any lateral movement of the figures being printed is prevented by the reconfiguration of the nozzles.

It should be noted that the subset SB of nozzles should be defined such that each nozzle of the subset can be positioned in the predetermined position (i.e. P1 in the above examples) in the X direction. Accordingly, definition of the subset SB is limited by the moving capability range of the print bar along its axis. Each lateral movement of the print bar should not be so great that the print bar can no longer print the full width of the image to be printed.

At S6, the print bar can be moved laterally in the X direction or at least in a direction having a component parallel to the print bar axis of the print bar.

In the examples described above, it is the print bar which is moved laterally to control the lateral position of the nozzles relative to the substrate. In an alternative example, the PWA printer is arranged such that it laterally moves the substrate to control the lateral positioning at S6. In a particular example, the substrate and the print bar may be movable in the lateral direction.

In the examples described above, the PWA printer may perform each print job in one pass (in single-pass printing mode).

In the examples described above, the controller laterally moves (S6) the print bar and reconfigures (S4) the nozzles accordingly once a print job is terminated. Alternatively, the controller may proceed with the lateral movement (S6) and the nozzle reconfiguration (S4) (in any order or simultaneously) while a print job of a given image is in progress. In that particular case, the controller interrupts the printing of an image in progress and proceeds with laterally moving the print bar and reconfiguring the nozzles as already explained so that the remaining portion of the image is printed in lateral alignment with the already printed portion of the image.

As already indicated above, each print job may be performed on a separate substrate or, alternatively, several print jobs may be printed on distinct portions of a same substrate.

According to a particular aspect of the present disclosure, the various stages of the printing method as described in the present disclosure are carried out by the PWA printer by running a computer program. The PWA printer may have for instance a hardware architecture of a computer, including for instance a processor capable of executing each operation in cooperation with appropriate memories.

Accordingly, the present disclosure also provides a computer program on a recording medium, this computer program being arranged to be implemented by the PWA printer, and more generally by a controller, this computer program including instructions adapted for the implementation of a printing method as described in the present disclosure.

The computer programs of the present disclosure can be expressed in any programming language, and can be in the form of source code, object code, or any intermediary code between source code and object code, such that in a partially-compiled form, for instance, or in any other appropriate form.

The present disclosure also discloses a recording medium readable by the PWA printer, or more generally by a controller, this recording medium including computer program instructions as mentioned above.

The recording medium previously mentioned can be any entity or device capable of storing the computer program. For example, the recording medium can include a storing means, such as a ROM memory (a CD-ROM or a ROM implemented in a microelectronic circuit), or a magnetic storing means such as a floppy disk or a hard disk for instance.

The recording medium of the invention can correspond to a transmittable medium, such as an electrical or an optical signal, which can be conveyed via an electric or an optic cable, or by radio or any other appropriate means. The computer program according to the invention can in particular be downloaded from the Internet or a network of the like.

Alternatively, the recording medium can correspond to an integrated circuit in which a computer program is loaded, the circuit being adapted to execute or to be used in the execution of the printing method of the present disclosure.

PARTICULAR EMBODIMENTS

Particular aspects of the present disclosure are described herebelow. In a particular aspect of the present disclosure, it is disclosed a page-wide array printer for printing an image on a substrate, the printer including:

a print bar along which a plurality of nozzles are provided, said print bar being operable to move laterally along its print bar axis;

a controller operable to:

cause the nozzles to print a first image in a first lateral alignment on a substrate while the print bar is in a first lateral position;

laterally move the print bar from the first to a second lateral position; and cause the nozzles to print a second image at the first lateral alignment while the print bar is in the second lateral position.

In a particular example, the first and second images are printed on two distinct substrates. In another example, the first and second images are printed on a same substrate.

In a particular example, the first and the second images are to distinct images. In another example, the first and second images are two distinct portions of a same image.

In a particular example, the PWA printer is arranged to print in one pass (in single-pass printing mode).

In a particular aspect of the present disclosure, it is disclosed a page-wide array printer for printing on a substrate an image made of columns of image data such that the first column of each image is positioned at a same predetermined position on a substrate, said printer including:

a print bar along which a plurality of nozzles are provided, and a controller operable to:

select one nozzle among a subset of said nozzles;

transmit said image data to be printed to the print bar such that the first data column of the image is input to the selected nozzle and the remaining data columns of said image are input respectively to adjacent nozzles of said selected nozzle so that the nozzles can print collectively said image; and position the print bar and the substrate relative to each other such that the selected nozzle is laterally positioned in alignment with the predetermined position on the substrate.

In a particular example, the PWA printer is arranged to print in one pass (in single-pass printing mode).

In a particular example, the controller is arranged such that it is statistically not always the same nozzle of the subset which is selected.

In a particular example, at each nozzle selection, the nozzle selected is different from the nozzle selected at the previous nozzle selection.

In a particular example, each of the nozzles of the subset is successively selected one after the other at each nozzle selection in a cyclic manner In another aspect of the present disclosure, the controller is arranged to perform a nozzle selection as defined above each time at least one predetermined condition is met.

The at least one predetermined condition may for instance include any one of the following:

a predetermined number of performed print jobs;

a predetermined level of usage of said nozzles;

a predetermined time elapsed since a previous nozzle selection; and usage of a predetermined plot type.

In a particular example, the controller is operable to cause the print bar to print an image on the substrate while the selected nozzle is positioned in alignment with the predetermined position.

In a particular example, the printing of said image is performed in one pass (in single-pass printing mode).

In a particular example, the PWA includes a print bar transport mechanism operable to control the lateral position of the print bar and the substrate relative to each other along the direction of the print bar axis so that the selected nozzle can be positioned in alignment with the predetermined position on the substrate.

In a particular example, the print bar transport mechanism is operable to laterally move the print bar to align the selected nozzle in correspondence with said predetermined position.

In a particular example, the subset of nozzles consists of a group of nozzles located at the left end of the bar print.

In another aspect of the present disclosure, it is disclosed a printing method carried out by a page wide array printer for printing an image on a substrate, the printer including a print bar along which a plurality of nozzles are provided, said print bar being operable to move laterally along its print bar axis, the method including:

causing the nozzles to print a first image in a first lateral alignment on a substrate while the print bar is in a first lateral position;

moving laterally the print bar from the first to a second position; and causing the nozzles to print a second image at the first lateral alignment while the print bar is in the second lateral position.

In still another aspect of the present disclosure, it is discloses a printing method carried out by a page wide array printer for printing on a substrate an image made of columns of image data such that the first column of each image is positioned at a same predetermined position on a substrate, the printer including a print bar along which a plurality of nozzles are provided, said method including:

selecting one nozzle among a subset of said nozzles;

transmitting said image data to be printed to the print bar such that the first data column of the image is input to the selected nozzle and the remaining data columns of the image are input respectively to adjacent nozzles of the selected nozzle so that the nozzles can print collectively said image; and positioning the print bar and the substrate relative to each other such that the selected nozzle is laterally positioned in alignment with the predetermined position on the substrate.

It is also disclosed a computer program including instructions to carry out a method as defined above when the computer program is run on a PWA printer.

Still further, it is disclosed a recording medium readable by a PWA printer, the recording medium storing a computer program including instructions for carrying out a method as defined above.

The present disclosure may include any combination of the above examples of implementation.

The invention claimed is:

1. A page-wide array printer for printing on a substrate an image made of columns of image data such that the first column of each image is positioned at a same predetermined position on a substrate, the printer comprising:

a print bar along which a plurality of nozzles is provided, the nozzles dynamically adjustable in relation to a width of a substrate such that which of the nozzles is positioned over a lateral position of the substrate is adjustable; and a controller to:

select a nozzle among a subset of the nozzles according to a rule to randomly select the nozzle among the subset of nozzles when the controller periodically dynamically adjusts the nozzles such that a first data column of the image is input to the selected nozzle;

transmit the image data to be printed to the print bar such that the first data column of the image is input to the selected nozzle and separate data columns of the image are input respectively to adjacent nozzles of the selected nozzle to enable the nozzles to collectively print the image; and position the print bar and the substrate relative to each other such that the selected nozzle is laterally positioned in alignment with the predetermined position on the substrate.

2. The page-wide array printer according to claim 1, wherein the controller is to perform the nozzle selection each time at least one predetermined condition is met.

3. The page-wide array printer according to claim 1, wherein the controller is to cause the print bar to print an image on the substrate while the selected nozzle is positioned in alignment with the predetermined position.

4. The page-wide array printer according to claim 1, wherein the subset of nozzles consists of a group of nozzles located at one end of the bar print.

5. The page-wide array printer according to claim 1, wherein a controller is further to:

cause the nozzles to print a first image in a first lateral alignment on a substrate while the print bar is in a first lateral position;

laterally move the print bar from the first to a second lateral position; and cause the nozzles to print a second image at the first lateral alignment while the print bar is in the second lateral position.

6. A method comprising:

selecting, by a controller of a page-wide array printer for printing on a substrate an image made of columns of image data such that the first column of each image is positioned at a same predetermined position on a substrate, a nozzle among a subset of a plurality of nozzles provided along a print bar of a page-wide array printer, the plurality of nozzles dynamically adjustable in relation to a width of a substrate such that which of the nozzles is positioned over a lateral position of the substrate is adjustable; the nozzle selected according to a rule to randomly select the nozzle among the subset of nozzles when the controller periodically dynamically adjusts the nozzles such that a first data column of the image is input to the selected nozzle;

transmitting, by the controller, the image data to be printed to the print bar such that the first data column of the image is input to the selected nozzle and separate data columns of the image are input respectively to adjacent nozzles of the selected nozzle to enable the nozzles to collectively print the image; and positioning, by the controller, the print bar and the substrate relative to each other such that the selected nozzle is laterally positioned in alignment with the predetermined position on the substrate.

7. The method according to claim 6, wherein the nozzle selection is performed by the controller each time at least one predetermined condition is met.

8. The method according to claim 6, further comprising:

causing, by the controller, the print bar to print an image on the substrate while the selected nozzle is positioned in alignment with the predetermined position.

9. The method according to claim 6, wherein the subset of nozzles consists of a group of nozzles located at one end of the bar print.

10. The method according to claim 6, further comprising:

causing the nozzles to print a first image in a first lateral alignment on a substrate while the print bar is in a first lateral position;

laterally moving the print bar from the first to a second lateral position; and causing the nozzles to print a second image at the first lateral alignment while the print bar is in the second lateral position.

* * * * *